US010077789B2

(12) United States Patent
Morice

(10) Patent No.: US 10,077,789 B2
(45) Date of Patent: Sep. 18, 2018

(54) PNEUMATIC ACTUATION SYSTEM AND METHOD

(71) Applicant: Peter G. Morice, Washington, DC (US)

(72) Inventor: Peter G. Morice, Washington, DC (US)

(73) Assignee: Peter G. Morice, Washington, DC (US)

( * ) Notice: Subject to any disclaimer, the term of this patent is extended or adjusted under 35 U.S.C. 154(b) by 227 days.

(21) Appl. No.: 15/045,547

(22) Filed: Feb. 17, 2016

(65) Prior Publication Data

US 2016/0245312 A1 Aug. 25, 2016

Related U.S. Application Data

(60) Provisional application No. 62/118,623, filed on Feb. 20, 2015.

(51) Int. Cl.
*F15B 15/14* (2006.01)
*F15B 15/28* (2006.01)
(Continued)

(52) U.S. Cl.
CPC ..... *F15B 15/1409* (2013.01); *F15B 15/02* (2013.01); *F15B 15/103* (2013.01);
(Continued)

(58) Field of Classification Search
CPC .. F15B 11/18; F15B 15/1409; F15B 15/1404; F15B 15/02
See application file for complete search history.

(56) References Cited

U.S. PATENT DOCUMENTS 3,598,019 A 8/1971 Killian
3,766,835 A * 10/1973 Kobelt ..... F01B 17/00 74/104
(Continued)

FOREIGN PATENT DOCUMENTS

FR 796582 A 4/1936
JP 37412 1/1962
(Continued)

OTHER PUBLICATIONS

Festo. "Fluidic Muscle DMSP/MAS." 2013, 36 pages.
(Continued)

*Primary Examiner* — Thomas E Lazo
(74) *Attorney, Agent, or Firm* — Faegre Baker Daniels, LLP

(57) ABSTRACT

An apparatus includes a plurality of pneumatic linear actuator modules, a dynamic actuator linkage, and a static actuator linkage. Each of the plurality of pneumatic linear actuator modules includes a static portion and a dynamic portion. The dynamic portion is movable in a linear fashion relative to the static portion. The dynamic actuator linkage connects the dynamic portion of each of the plurality of pneumatic linear actuator modules to a moveable portion of a device. The static actuator linkage connects the static portion of each of the plurality of pneumatic linear actuator modules to an immoveable portion of the device. A number of pneumatic linear actuator modules one less than the plurality of pneumatic linear actuator modules are able to provide linear actuation to the device. Each of the plurality of actuator modules is configured to selectively couple and decouple to the dynamic actuator linkage and the static actuator linkage.

21 Claims, 6 Drawing Sheets

(51) Int. Cl.

| | |
|---|---|
| ***F15B 15/02*** | (2006.01) |
| ***F15B 15/10*** | (2006.01) |
| *F15B 5/00* | (2006.01) |

(52) U.S. Cl.

CPC ..... *F15B 15/1404* (2013.01); *F15B 15/2815* (2013.01); *F15B 5/006* (2013.01); *F15B 2211/30595* (2013.01); *F15B 2211/365* (2013.01); *F15B 2211/6313* (2013.01); *F15B 2211/6336* (2013.01); *F15B 2211/665* (2013.01); *F15B 2211/6653* (2013.01); *F15B 2211/7107* (2013.01); *F15B 2211/865* (2013.01)

(56) References Cited

U.S. PATENT DOCUMENTS

| | | | | |
|---|---|---|---|---|
| 3,967,809 | A | 7/1976 | Skantar | |
| 4,373,334 | A * | 2/1983 | Carlander ..... | A47B 9/10 248/188.5 |
| 4,577,654 | A | 3/1986 | Pringle | |
| 5,052,273 | A | 10/1991 | Sakaguchi | |
| 5,067,390 | A | 11/1991 | Negishi | |
| 5,197,328 | A | 3/1993 | Fitzgerald | |
| 5,431,182 | A | 7/1995 | Brown | |
| 5,975,492 | A | 11/1999 | Brenes | |
| 6,209,443 | B1 | 4/2001 | Perez | |
| 7,104,182 | B2 | 9/2006 | Reininger | |
| 7,617,874 | B2 | 11/2009 | Ocalan | |
| 8,820,342 | B2 | 9/2014 | Do et al. | |
| 2004/0035181 | A1 | 2/2004 | DeRuiter et al. | |
| 2009/0100962 | A1 | 4/2009 | Uracz et al. | |
| 2009/0173178 | A1 | 7/2009 | Okazaki | |

FOREIGN PATENT DOCUMENTS

| | | | |
|---|---|---|---|
| JP | S42017216 | | 9/1967 |
| JP | S5256194 | U | 4/1977 |
| JP | S53147178 | A | 12/1978 |
| JP | S58181981 | A | 10/1983 |
| JP | S6024905 | U | 2/1985 |
| JP | S60146909 | A | 8/1985 |
| JP | 6235405 | A | 8/1994 |
| JP | H09196006 | A | 7/1997 |
| JP | 2000257604 | A | 9/2000 |
| JP | 2004197769 | A | 7/2004 |

OTHER PUBLICATIONS

International Search Report and Written Opinion issued in PCT/US2016/018183, dated Apr. 19, 2016, 14 pages.

Norgren. "Integrating Valves and Actuators Optimizes Pneumatic Motion Control Efficiency: Integrated Valve and Actuator Control (IVAC) Simplifies, Enhances Pneumatic Control Systems." pp. 516.01-516.08, 2012.

* cited by examiner

PNEUMATIC ACTUATION SYSTEM AND METHOD

CROSS-REFERENCE TO RELATED APPLICATION

This application claims priority to Provisional Application No. 62/118,623, filed Feb. 20, 2015, which is herein incorporated by reference in its entirety.

TECHNICAL FIELD

The present invention relates to a pneumatic actuation system. More specifically, the invention relates to a system and method for linear actuation of an industrial device.

BACKGROUND

Industrial control systems are commonly employed to provide control and monitoring of industrial facilities and processes, such as oil refining processes, oil and gas transportation facilities, chemical processing, pharmaceutical processing, and power generation facilities. Industrial control systems rely on actuators to position control elements, such as valves, to effectuate control actions. For reasons of safety and efficiency, some industrial control systems rely on pneumatically driven actuators to position control elements. Many industrial facilities and processes operate continuously for extended periods of time because shutting down and starting up facilities and processes can be costly. Unplanned shut down of a facility or process can be especially disruptive and expensive. Thus, highly reliable pneumatically actuated control elements are desired to prevent costly facility or process downtime.

SUMMARY

In Example 1, an apparatus for providing linear actuation to a device having a moveable portion and an immoveable portion includes a plurality of pneumatic linear actuator modules, a dynamic actuator linkage, and a static actuator linkage. Each of the plurality of pneumatic linear actuator modules includes a static portion and a dynamic portion, wherein the dynamic portion is moveable in a linear fashion relative to the static portion. The dynamic actuator linkage is configured to connect the dynamic portion of each of the plurality of pneumatic linear actuator modules to the moveable portion of the device. The static actuator linkage is configured to connect the static portion of each of the plurality of pneumatic linear actuator modules to the immoveable portion of the device. A number of pneumatic linear actuator modules one less than the plurality of pneumatic linear actuator modules are configured to provide linear actuation to the device. Each of the plurality of actuator modules is configured to selectively couple and decouple to the dynamic actuator linkage and the static actuator linkage.

In Example 2, the apparatus of Example 1, wherein the device is a control valve, the moveable portion of the device is a valve stem, and the immoveable portion is a bonnet.

In Example 3, the apparatus of Example 2, wherein the static actuator linkage is integral with the bonnet.

In Example 4, the apparatus of any of Examples 2-3, wherein the dynamic actuator linkage is integral with the valve stem.

In Example 5, the apparatus of any of Examples 1-4, wherein each of the plurality of actuator modules includes a first member, a second member, a plurality of linear guides connecting the first member to the second member, a plurality of linear bearings configured to move along the plurality of linear guides, a translating member connected to the plurality of linear bearings, a fluidic actuator connecting the translating member to the first member, and a pneumatic fitting connected to the fluidic actuator. The pneumatic fitting is configured to connect the fluidic actuator to a pneumatic line. The translating member is the dynamic portion of the pneumatic linear actuator module and the second member is the static portion of the pneumatic linear actuator module.

In Example 6, the apparatus of Example 5, further including a pneumatic controller configured to selectively couple and decouple to each of the plurality of pneumatic linear actuator modules. The controller is configured to control actuation of the plurality of pneumatic linear actuator modules.

In Example 7, the apparatus of Example 6, wherein the pneumatic controller includes a processor configured to receive a control input, a position transducer electrically connected to the processor, and a pneumatic control mechanism electrically connected to the processor. The position transducer is configured to sense a position of the movable portion of the device relative to the immoveable portion of the device. The pneumatic control mechanism is configured to connect a compressed gas supply to the plurality of pneumatic linear actuators and configured to modulate a pressure of the compressed gas supplied to the plurality of pneumatic linear actuators in response to an electrical signal from the processor. The electrical signal from the processor is function of at least the control input and the sensed position of the moveable portion of the device relative to the immoveable portion of the device.

In Example 8, the apparatus of Example 7, wherein the pneumatic controller further includes a pressure transducer electrically connected to the processor and configured to sense the pressure of the compressed gas supplied to the plurality of pneumatic linear actuators, and wherein the electrical signal from the processor is additionally a function of the sensed pressure of the compressed gas supplied to the plurality of pneumatic linear actuators.

In Example 9, the apparatus of Example 6, wherein the first member is a first plate, a second member is a second plate, and the translating member is a translating plate, and wherein each of the plurality of actuator modules further includes a biasing member configured to apply a biasing force countering a force applied between the first plate and the translating plate by the fluidic actuator.

In Example 10, the apparatus of Example 9, wherein each of the plurality of actuator modules further includes a threaded cylindrical column and a nut. The threaded column is connected on one end to the translating plate and projects toward the first plate. The column includes a hollow interior extending the length of the column, and an exterior including threads extending at least a portion of the length of the column. The nut is configured to threadedly engage the threads of the column. The biasing member is disposed between the nut and the first plate such that the biasing force is adjustable by threading the nut along the column.

In Example 11, the apparatus of any of Examples 9-10, wherein each of the plurality of actuator modules further includes a position transducer electrically connected to the pneumatic controller and configured to sense a position of the translating plate.

In Example 12, the apparatus of Example 11, wherein the pneumatic controller includes a processor and a pneumatic control mechanism. The processor is configured to receive a control input and is electrically connected to the position transducer of each of the plurality of actuator modules. The pneumatic control mechanism is electrically connected to the processor. The pneumatic control mechanism is configured to connect a compressed gas supply to the plurality of pneumatic linear actuators, and is configured to modulate a pressure of the compressed gas supplied to the plurality of pneumatic linear actuators in response to an electrical signal from the processor. The electrical signal from the processor is function of at least the control input and the sensed position of the translating plate of each of the plurality of pneumatic linear actuator modules.

In Example 13, the apparatus of Example 12, wherein the each of the plurality of actuator modules further includes a pressure transducer electrically connected to the processor and configured to sense the pressure of the compressed gas supplied to the pneumatic linear actuator, and wherein the electrical signal from the processor is additionally a function of the sensed pressure of the compressed gas supplied to each of the plurality of pneumatic linear actuators.

In Example 14, the apparatus of Example 1, wherein each of the plurality of actuator modules includes a first member, a second member, a plurality of linear guides connecting the first member to the second member, a plurality of linear bearings configured to move along the plurality of linear guides, a translating member connected to the plurality of linear bearings, a fluidic actuator connecting the translating member to the first member, a first pneumatic fitting connected to the fluidic actuator, and a pneumatic controller. The first pneumatic fitting is configured to selectively couple the pneumatic linear actuator module to a compressed gas supply. The pneumatic controller is configured to selectively couple the pneumatic linear actuator module to a control input. The pneumatic controller includes a processor configured to receive the control input, a position transducer electrically connected to the processor and configured to sense a position of the translating member, and a pneumatic control mechanism electrically connected to the processor. The pneumatic control mechanism is configured to connect a compressed gas supply from the pneumatic line to the plurality of pneumatic linear actuators. The pneumatic control mechanism is also configured to modulate a pressure of the compressed gas supplied to the pneumatic linear actuator in response to an electrical signal from the processor. The electrical signal from the processor is function of at least the control input and the sensed position of the translating member.

In Example 15, the apparatus of Example 14, wherein the first member is a first plate, a second member is a second plate, and the translating member is a translating plate, and wherein each of the plurality of actuator modules further includes a biasing member configured to apply a biasing force countering a force applied between the first plate and the translating plate by the fluidic actuator.

In Example 16, the apparatus of Example 15, wherein each of the plurality of actuator modules further includes a threaded cylindrical column and a nut. The threaded cylindrical column is connected on one end to the translating plate and projects toward the first plate. The column includes a hollow interior extending the length of the column, and an exterior including threads extending at least a portion of the length of the column. The nut is configured to threadedly engage the threads of the column. The biasing member is disposed between the nut and the first plate such that the biasing force is adjustable by threading the nut along the column.

In Example 17, the apparatus of any of Examples 14-16, wherein the each of the plurality of pneumatic linear actuator modules further includes a pressure transducer electrically connected to the processor and configured to sense the pressure of the compressed gas supplied to the fluidic actuator, and wherein the electrical signal from the processor is additionally a function of the sensed pressure of the compressed gas supplied to the fluidic actuator.

In Example 18, the apparatus of any of Examples 14-17, wherein the processors of each of the plurality of pneumatic linear actuator modules are electrically connected to the local control loop to receive the control input.

In Example 19, the apparatus of Example 18, wherein one of the plurality of pneumatic linear actuator modules provides the control input to each of the remaining plurality of pneumatic linear actuator modules.

In Example 20, the apparatus of any of Examples 14-19, further including a common header configured to pneumatically connect to the fluidic actuators of each of the plurality of actuator modules. Each of the plurality of actuator modules further includes a second pneumatic fitting connected to the fluidic actuator, the second pneumatic fitting configured to selectively couple the pneumatic linear actuator module to the common header. The pneumatic controller further includes a first pneumatic valve to selectively connect the fluid actuator to the compressed gas supply, and a second pneumatic valve to selectively connect the fluid actuator to the common header.

Example 21 is a method for providing linear actuation of a device having a moveable portion and an immoveable portion includes coupling a plurality of pneumatic linear actuation modules to the device, connecting a compressed gas supply to each of the plurality of pneumatic linear actuation modules, and modulating a pressure of the compressed gas supplied to the plurality of pneumatic linear actuators to provide linear actuation of the device. Coupling the plurality of pneumatic linear actuation modules to the device includes connecting a dynamic portion of each of the pneumatic linear actuator modules to the moveable portion of the device, and connecting a static portion of each of the pneumatic linear actuator modules to the immoveable portion of the device. A number of pneumatic linear actuator modules one less than the plurality of pneumatic linear actuator modules are able to provide linear actuation of the device.

In Example 22, the method of Example 21, further including replacing a one of the plurality of pneumatic linear actuation modules while modulating the pressure of the remainder of the plurality of pneumatic linear actuation modules to provide uninterrupted linear actuation of the device.

In Example 23, the method of Example 22, wherein the one of the plurality of pneumatic linear actuation modules comprise a failed or failing one of the plurality of pneumatic linear actuation modules and wherein the replacing includes identifying the failed or failing one of the plurality of pneumatic linear actuation modules to be replaced, disconnecting the compressed gas supply from the identified pneumatic linear actuation module, decoupling the identified pneumatic linear actuation module from the device, coupling a replacement pneumatic linear actuation module to the device, and connecting the compressed gas supply to the replacement pneumatic linear actuation module. Decoupling the identified pneumatic linear actuation module from the device includes disconnecting the dynamic portion of the pneumatic linear actuator module from the moveable portion of the device, and disconnecting the static portion of the pneumatic linear actuator module from the immoveable portion of the device. Coupling a replacement pneumatic linear actuation module to the device includes connecting a dynamic portion of the replacement pneumatic linear actuator module to the moveable portion of the device, and connecting a static portion of the replacement pneumatic linear actuator module to the immoveable portion of the device.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
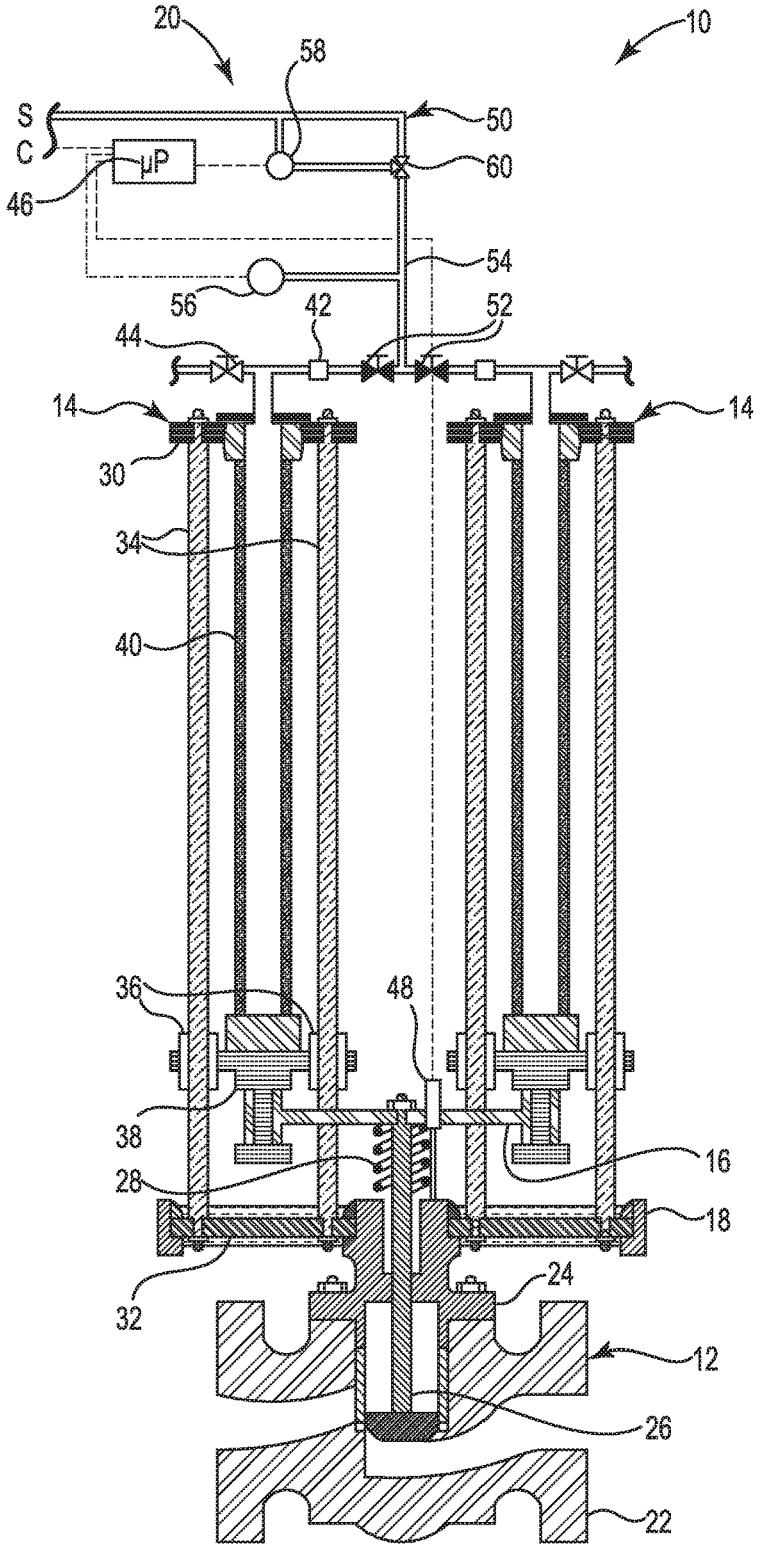
FIGS. 1A and 1B are schematic cross-sectional views of an apparatus in accordance with embodiments of the present invention.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

A more complete understanding of the present invention is available by reference to the following detailed description of numerous aspects and embodiments of the invention. The detailed description of the invention which follows is intended to illustrate, but not limit, the invention.

Figure 1B:
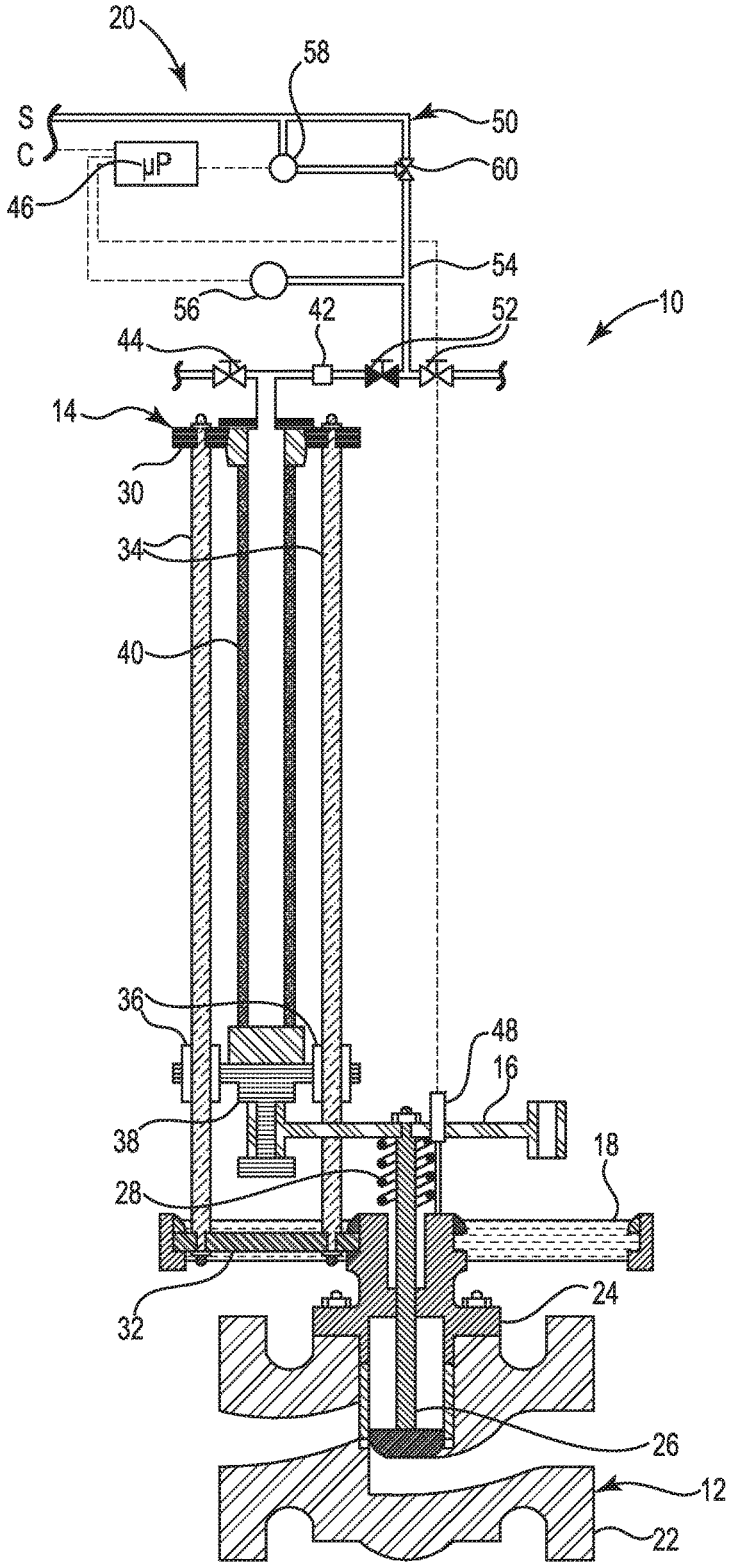

FIGS. 1A and 1B are schematic cross-sectional views of an exemplary linear actuation apparatus connected to a device for providing linear actuation to a device, in accordance with embodiments of the present invention. FIG. 1A shows a linear actuation apparatus 10 connected to a device 12. The linear actuation apparatus 10 may include a plurality of pneumatic linear actuator modules 14 (two shown in FIG. 1A), a dynamic actuator linkage 16, a static actuator linkage 18, and a pneumatic controller 20. The device 12 may be a normally closed control valve and may include a valve body 22, a bonnet 24, a stem 26, and a valve spring 28. The bonnet 24 is connected to the valve body 22 to guide the stem 26 and seal an interior of the valve body 22. The valve spring 28 is configured to apply a biasing force to maintain the stem 26 in a closed position, absent any countering a force applied by the linear actuation apparatus 10. As such, the stem 26 may be a moveable portion of the device 12, and the bonnet 24 may be an immoveable portion of the device 12, with the term "immoveable" not intended to mean absolutely immoveable but rather substantially immoveable or immoveable in comparison to the moveable aspect of the moveable portion. As also shown in FIG. 1A, the dynamic actuator linkage 16 is configured to connect each of the plurality of pneumatic linear actuator modules 14 to the movable portion of device 12, the stem 26; and the static actuator linkage 18 is configured to connect each of the plurality of pneumatic linear actuator modules 14 to the immoveable portion of device 12, the bonnet 24. The term "static" is not intended to mean absolutely lacking in movement or unchanging, but rather substantially static or static in comparison to the dynamic aspect of the dynamic actuator linkage 16. In the embodiment shown in FIG. 1A, the dynamic actuator linkage 16 is connected to the valve stem 26 by a nut and bolt, or other fastening device. In other embodiments, the dynamic actuator linkage 16 may be integrally formed with the valve stem 26. In the embodiment shown in FIG. 1A, the static actuator linkage 18 is integrally formed with the bonnet 24. In other embodiments, the static actuator linkage 18 may be connected to the bonnet 24 by a nut and bolt, or other fastening device or means.

Each of the pneumatic linear actuator modules 14 may be substantially the same, as shown in the embodiment of FIGS. 1A and 1B. Each of the pneumatic linear actuator modules 14 may include a first member or plate 30, a second member or plate 32, a plurality of linear guides 34 (two shown for each pneumatic linear actuator module 14), a plurality of linear bearings 36 (two shown for each linear actuator module 14), a translating member or plate 38, a fluidic actuator 40, a pneumatic fitting 42 and bleed valve 44. The plurality of linear guides 34 may connect the first member 30 to the second member 32. In some embodiments, three linear guides 34 may connect the first member 30 to the second member 32. Each of the plurality of linear bearings 36 is configured to move along one of the plurality of linear guides 34. In some embodiments, there may be three linear bearings 36. The translating member 38 may be connected to the plurality of linear bearings 36. The second member 32 may be a static portion of the pneumatic linear actuation module 14. The translating member 38 may be a dynamic portion of the pneumatic linear actuation module 14. The translating member 38, or dynamic portion, is moveable in a linear fashion relative to the second member 32, or static portion, as the plurality of linear bearings 36 connected to the translating member 38 move along the plurality of linear guides 34 connected to the second member 32.

As also shown in FIG. 1A, the dynamic actuator linkage 16 may be configured to connect the translating member 38 of each of the plurality of linear actuator modules 14 to the stem 26 of the device 12. The static actuator linkage 18 may be configured to connect the second member 32 of each of the plurality of linear actuator modules 14 to the bonnet 24 of the device 12.

The fluidic actuator 40 may connect the translating member 38 to the first member 30. The pneumatic fitting 42 may selectively connect the fluidic actuator 40 to a controlled pressure, as described below. The pneumatic fitting 42 may be any type of fitting suitable for reliably connecting and disconnecting the pneumatic linear actuator module 14 to a pneumatic line, for example, a quick disconnect fitting or a threaded fitting. The bleed valve 44 may selectively connect the fluidic actuator 40 to an ambient environment. The fluidic actuator 40 may be a tensile actuator, such as a Fluidic Muscle available from the Festo Corporation. The fluidic actuator 40 may also be referred to as air muscle. The fluidic actuator 40 may be a hollow tubular structure having walls that are flexible, but substantially inelastic. As pressure within the flexible walls of the fluidic actuator 40 increases, the flexible walls are forced outward. As the flexible walls are forced outward, a tensile force is generated between opposite ends of the fluidic actuator 40. The fluidic actuator 40 is able to provide significant tensile force in a form factor that has a relatively small cross-sectional area in a direction perpendicular to the tensile force.

As also shown in FIG. 1A, the pneumatic controller 20 may include a processor 46, a position transducer 48, a pneumatic control mechanism 50, a plurality of header isolation valves 52 (two shown in FIG. 1A), and a pneumatic control line or header 54. The pneumatic controller 20 may optionally include a pressure transducer 56. The processor 46 may be electrically connected to a control input C, the position transducer 48, the pneumatic control mechanism 50, and the pressure transducer 56. The control input C may be electrically connected to an industrial control system (not shown) to receive a control signal from the industrial control system. The processor 46 may be an electronic microprocessor. The pneumatic control mechanism 50 may pneumatically connect a compressed gas supply S to the pneumatic control line 54. The compressed gas supply S may supply any type of gas at a pressure high enough to operate the linear actuation apparatus 10. The pneumatic control line 54 may be pneumatically connected to the pneumatic fitting 42. Each of the plurality of header isolation valves 52 is disposed between the pneumatic control line 54 and the pneumatic fitting 42 of a corresponding one of each of the pneumatic linear actuator modules 14. By selectively opening or closing one of the plurality of header isolation valves 52, a corresponding one of the plurality of pneumatic linear actuator modules 14 may be selectively connected to, or isolated from, the pneumatic control line 54.

In some embodiments, the pneumatic control mechanism 50 may include a current-to-pressure (I/P) transducer 58 and a volume booster 60. The I/P transducer 58 is electrically connected to the processor 46 and pneumatically connects the compressed gas supply S to the volume booster 60. The volume booster 60 is also directly pneumatically connected to the compressed gas supply S and to the pneumatic control line 54.

In some embodiments, the position transducer 48 may be, for example, a linear potentiometer physically connected to the dynamic actuator linkage 16 and the static actuator linkage 18 to produce an electrical signal indicative of a position of the dynamic actuator linkage 16 relative to the static actuator linkage 18. In other embodiments, the position transducer 48 may be, for example, a capacitive sensing device or an electromagnetic flux sensing device (Hall Effect sensor) physically connected to one of the dynamic actuator linkage 16 and the static actuator linkage 18, and configured to capacitively sense a relative position of the other of the dynamic actuator linkage 16 and the static actuator linkage 18.

In some embodiments including the optional pressure transducer 56, the pressure transducer 56 may employ any of a number of known pressure sensing technologies, including, for example, piezoresistive strain gauge, capacitive, or electromagnetic. The pressure transducer 56 may be pneumatically connected to the pneumatic control line 54 to produce an electrical signal indicative of a pressure in the pneumatic control line 54. In some embodiments, the pressure transducer 56 may be an absolute pressure transducer and the electronic signal may be indicative of the absolute pressure in the pneumatic control line 54. In other embodiments, the pressure transducer 56 may be a gauge pressure transducer, and the electrical signal may be indicative of a difference between the pressure in the pneumatic control line 54 and a pressure of the ambient environment.

In operation, the processor 46 of pneumatic controller 20 may receive the control signal from the control input C indicating a desired level of actuation of the device 12, for example increasing the level of actuation by moving the stem 26 away from the fully closed position. The processor 46 sends an electrical signal to the I/P transducer 58 of the pneumatic control mechanism 50. The electrical signal may be a function of the signal from the control input C, the electrical signal from the position transducer 48, and optionally the signal from the pressure transducer 56. The I/P transducer 58 modulates a pressure from the compressed gas supply S in response to the electrical signal from the processor 46 to provide a pneumatic control signal to the volume booster 60. The pneumatic control signal from the I/P transducer 58 increases the pressure supplied by volume booster 60 from the compressed gas supply S to the pneumatic control line 54.

Each of the plurality of header isolation valves 52 may be in an open position such that the increased pressure from the pneumatic control mechanism 50 is supplied from the pneumatic control line 54 to the fluidic actuator 40 of each of the pneumatic linear actuator modules 14 by way of the pneumatic fitting 42. Within each of the pneumatic linear actuator modules 14, the increased pressure supplied from the pneumatic control line 54 increases the pressure within the fluidic actuator 40, generating a tensile force between opposite ends of the fluidic actuator 40. As noted above, the fluidic actuator 40 may connect the translating member 38 to the first member 30. Thus, the tensile force generated by the fluidic actuator 40 pulls the translating member 38 toward the first member 30 and away from the second member 32. Movement of the translating member 38 toward the first member 30 and away from the second member 32 for each of the plurality of pneumatic linear actuator modules 14 also moves the dynamic actuator linkage 16 away from the static actuator linkage 18. The tensile force produced by the plurality of pneumatic linear actuator modules 14 is sufficient to overcome the biasing force of the valve spring 28 and move the valve stem 26 away from the fully closed position.

Fine adjustment of the position of the stem 26 may be accomplished through the electrical signal from the position transducer 48. This is a feedback signal indicative of the position of the dynamic actuator linkage 16 relative to the static actuator linkage 18. The processor 46 may adjust the electrical signal sent to the I/P transducer 58 to increase or decrease the pressure supplied to the plurality of pneumatic linear actuator modules 14, adjusting the position of the stem 26 accordingly.

Optionally, additional fine control of the pressure supplied to the fluidic actuator 40 may be accomplished through the electrical signal from the pressure transducer 56. This is a feedback signal indicative of the pressure in the pneumatic control line 54. The processor 46 may adjust the electrical signal sent to the I/P transducer 58 to further modulate the pressure supplied by volume booster 60 from the compressed gas supply S to the pneumatic control line 54.

The embodiment of the linear actuation apparatus 10 shown in FIG. 1A includes two pneumatic linear actuator modules 14 which together provide linear actuation of device 12 throughout the operable range of motion of the stem 26, such that a flow through the valve body 22 may range from fully closed to fully open. In some embodiments, the linear actuation apparatus 10 is configured such that a number of pneumatic linear actuator modules 14 one less than the plurality of pneumatic linear actuator modules 14 are able to provide linear actuation to the device 12. This ability to "hot swap" is very advantageous in that should one of the plurality of pneumatic linear actuator modules 14 fail, it may be replaced without any downtime in the operation of the linear actuation apparatus 10 and its control of device 12. For example, once one of the pneumatic linear actuator modules 14 has been identified as failed or failing, replacement begins by disconnecting or isolating the pneumatic linear actuator module 14 from the compressed gas supplied by the pneumatic controller 20. This may be done by closing the header isolation valve 52 for the pneumatic linear actuator module 14 to be replaced. The bleed valve 44 may then be opened to relieve any pressure within and pneumatic fitting 42 of the pneumatic linear actuator module 14 to be replaced may be disconnected from the pneumatic control line 54. Once the header isolation valve 52 is closed and the bleed valve 44 is opened, the linear actuation apparatus 10 may operate with little, if any, interference from the now pneumatically disconnected pneumatic linear actuator 14. The pneumatic linear actuator module 14 to be replaced may then be physically decoupled from the linear actuation apparatus 10 by disconnecting the translating member 38 from the dynamic actuator linkage 16, and disconnecting the second member 32 from the static actuator linkage 18. The result is illustrated in FIG. 1B, showing one of the plurality of pneumatic linear actuator modules 14 removed, and the corresponding header isolation valve 52 is closed so that pneumatic controller 20 may continue to control the remaining pneumatic linear actuator module 14 and device 12.

Installing a replacement pneumatic linear actuator module 14 is done by connecting the second member 32 to the static actuator linkage 18, and connecting the translating member 38 to the dynamic actuator linkage 16 to physically couple the replacement pneumatic linear actuator module 14. Then the pneumatic fitting 42 of the replacement pneumatic linear actuator module 14 may be connected to the pneumatic control line 54 and the bleed valve 44 closed. Next, the header isolation valve 52 for the replacement pneumatic linear actuator module 14 may be opened to connect the replacement pneumatic linear actuator module 14 to the compressed gas supplied by the pneumatic controller 20. The result is as shown in FIG. 1A. In this way, a failed or failing pneumatic linear actuator module 14 may be replaced with no downtime in the operation of device 12.

In the embodiment of FIGS. 1A and 1B, this a single pneumatic linear actuator module 14, which is one less than the two pneumatic linear actuator modules 14 in the embodiment, is able to provide linear actuation of device 12. In other embodiments in which the plurality of pneumatic linear actuation modules 14 is, for example, three pneumatic linear actuator modules 14, only two pneumatic linear actuator modules 14 are necessary to provide linear actuation of the device 12. In still further embodiments in which the plurality of pneumatic linear actuation modules 14 is, for example, n pneumatic linear actuator modules 14, a number of pneumatic linear actuator modules 14 one less than n is sufficient to provide linear actuation of the device 12, wherein n may be any number greater than 1.

In some embodiments, it may not be beneficial to operate the linear actuation apparatus 10 for an extended period of time with a number of pneumatic linear actuator modules 14 one less than n. However, for relatively short periods of time, for example, time sufficient to detect a failure of one of the plurality of pneumatic linear actuator modules 14 and replace it as describe above, operating with a number of pneumatic linear actuator modules 14 one less than n may not result in significant stress on the pneumatic linear actuator modules 14.

Figure 2:
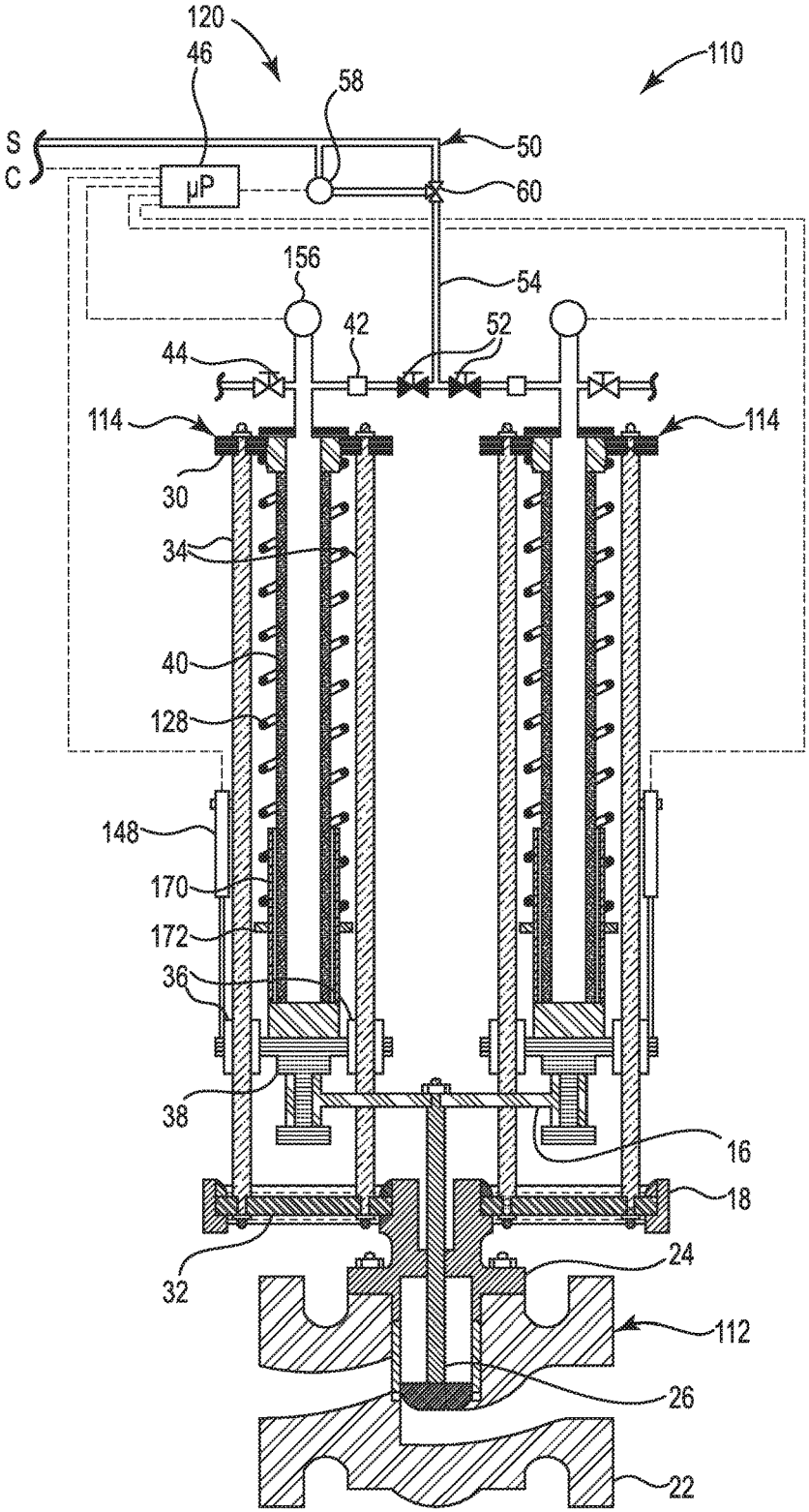
FIG. 2 is a schematic cross-sectional view of another apparatus in accordance with embodiments of the present invention.

FIG. 2 is a schematic cross-sectional view of another exemplary linear actuation apparatus connected to a device for providing linear actuation to the device, in accordance with embodiments of the present invention. FIG. 2 shows a linear actuation apparatus 110 connected to a device 112. The linear actuation apparatus 110 may include a plurality of pneumatic linear actuator modules 114 (two shown in FIG. 2), the dynamic actuator linkage 16, the static actuator linkage 18, and a pneumatic controller 120. The device 112 may be identical to the device 12 described above in reference to FIG. 1A, except that it does not include the valve spring 28. The dynamic actuator linkage 16 and the static actuator linkage 18 may be as described above in reference to FIG. 1A.

Each of the pneumatic linear actuator modules 114 may be substantially the same. The pneumatic linear actuator module 114 may be identical to the pneumatic linear actuator module 14 described above, except that each of the pneumatic linear actuator modules 114 may further include a biasing element 128, a position transducer 148, a pressure transducer 156, a threaded column 170, and a threaded nut 172.

The position transducer 148 may be identical to the position transducer 48 described above in reference to FIG. 1A, except that the position transducer 148 may be physically connected to the translating member 38 and one of the plurality of linear guides 34 to produce an electrical signal indicative of a position of the dynamic actuator linkage 16 relative to the static actuator linkage 18. The position transducer 148 in each of the plurality of pneumatic linear actuator modules 114 may be electrically connected to the processor 46.

The pressure transducer 156 may be identical to the pressure transducer 56 described above in reference to FIG. 1A, except that the pressure transducer 156 may be configured to produce an electrical signal indicative of a pressure between the pneumatic fitting 42 and the fluidic actuator 40. The pressure transducer 156 in each of the plurality of pneumatic linear actuator modules 114 may be electrically connected to the processor 46.

The biasing element 128 may be a spring, such as a coil spring, or an elastomeric device. The biasing element 128 may be configured to apply a biasing force between the translating member 38 and the first member 30 in opposition to the tensile force generated by the fluidic actuator 40.

As shown in FIG. 2, in some embodiments the threaded column 170 may be a hollow tubular structure open at both ends. The threaded column 170 may include a hollow interior extending a full length of the threaded column 170, and an exterior including threads extending along at least a portion of the full length of threaded column 170. In some embodiments, the threaded column may be connected on one end to the translating member 38 and project toward the first member 30. The threaded nut 172 may be configured to threadedly engage the threads on the exterior of the threaded column 170. The biasing element 128 may be disposed between the threaded nut 172 and the first member 38 to apply the biasing force between the translating member 38 and the first member 30 in opposition to the tensile force generated by the fluidic actuator 40. The biasing force may adjustable in magnitude by threading the threaded nut 172 along the threaded column 170.

The pneumatic controller 120 may be identical to the pneumatic controller 20 described above in reference to FIG.

1A, except that it does not include the position transducer 48 or the pressure transducer 56, because the position transducer 148 and the pressure transducer 156 may be included in each of the pneumatic linear actuators 114.

In operation, the processor 46 of pneumatic controller 120 may receive a signal from the control input C indicating a desired level of actuation of the device 12, for example increasing the level of actuation by moving the stem 26 away from the fully closed position. The processor 46 sends an electrical signal to the I/P transducer 58 of the pneumatic control mechanism 50. The electrical signal may be a function of the signal from the control input C, the electrical signals from each of the position transducers 148, and the electrical signals from each of the pressure transducers 156. The I/P transducer 58 modulates a pressure from the compressed gas supply S in response to the electrical signal from the processor 46 to provide a pneumatic control signal to the volume booster 60. The pneumatic control signal from the I/P transducer 58 increases the pressure supplied by volume booster 60 from the compressed gas supply S to the pneumatic control line 54.

Each of the plurality of header isolation valves 52 may be in an open position such that the increased pressure from the pneumatic control mechanism 50 is supplied from the pneumatic control line 54 to the fluidic actuator 40 of each of the pneumatic linear actuator modules 114 by way of the pneumatic fitting 42. Within each of the pneumatic linear actuator modules 114, the increased pressure supplied from the pneumatic control line 54 increases the pressure within the fluidic actuator 40, generating a tensile force between opposite ends of the fluidic actuator 40. The tensile force generated by the fluidic actuator 40 pulls the translating member 38 toward the first member 30 and away from the second member 32. Movement of the translating member 38 toward the first member 30 and away from the second member 32 for each of the plurality of pneumatic linear actuator modules 114 also moves the dynamic actuator linkage 16 away from the static actuator linkage 18. The tensile force produced by the plurality of pneumatic linear actuator modules 114 is sufficient to overcome the biasing force of the biasing elements 128 in each of the pneumatic linear actuator modules 114 and move the valve stem 26 away from the fully closed position.

Fine adjustment of the position of the stem 26 may be accomplished through the electrical signals from each of the position transducers 148 to the processor 46. Fine control of the pressure supplied to the fluidic actuator 40 may be accomplished through the electrical signals from each of the pressure transducers 156 to the processor 46.

As with the embodiment of the linear actuation apparatus 10 described above in reference to FIGS. 1A and 1B, the linear actuation apparatus 110 is configured such that a number of pneumatic linear actuator modules 114 one less than the plurality of pneumatic linear actuator modules 114 are able to provide linear actuation to the device 112. Should one of the plurality of pneumatic linear actuator modules 114 fail, it may be replaced without any downtime in the operation of the linear actuation apparatus 110 and its control of device 112.

The linear actuation apparatus 110 may be more reliable than the linear actuation apparatus 10 described above in reference to FIG. 1A because if one of the position transducers 148 or one of the pressure transducers 156 fail, the information is still provided to the processor 46 by functional position transducers 148 and pressure transducers 156 on the other pneumatic linear actuator modules 114. In addition, unlike the linear actuation apparatus 10, replacing a failed position transducer 148 or a failed pressure transducer 156 requires no downtime because they are part of the pneumatic linear actuator modules 114, which may be replaced without any system downtime, as described above.

Figure 3:
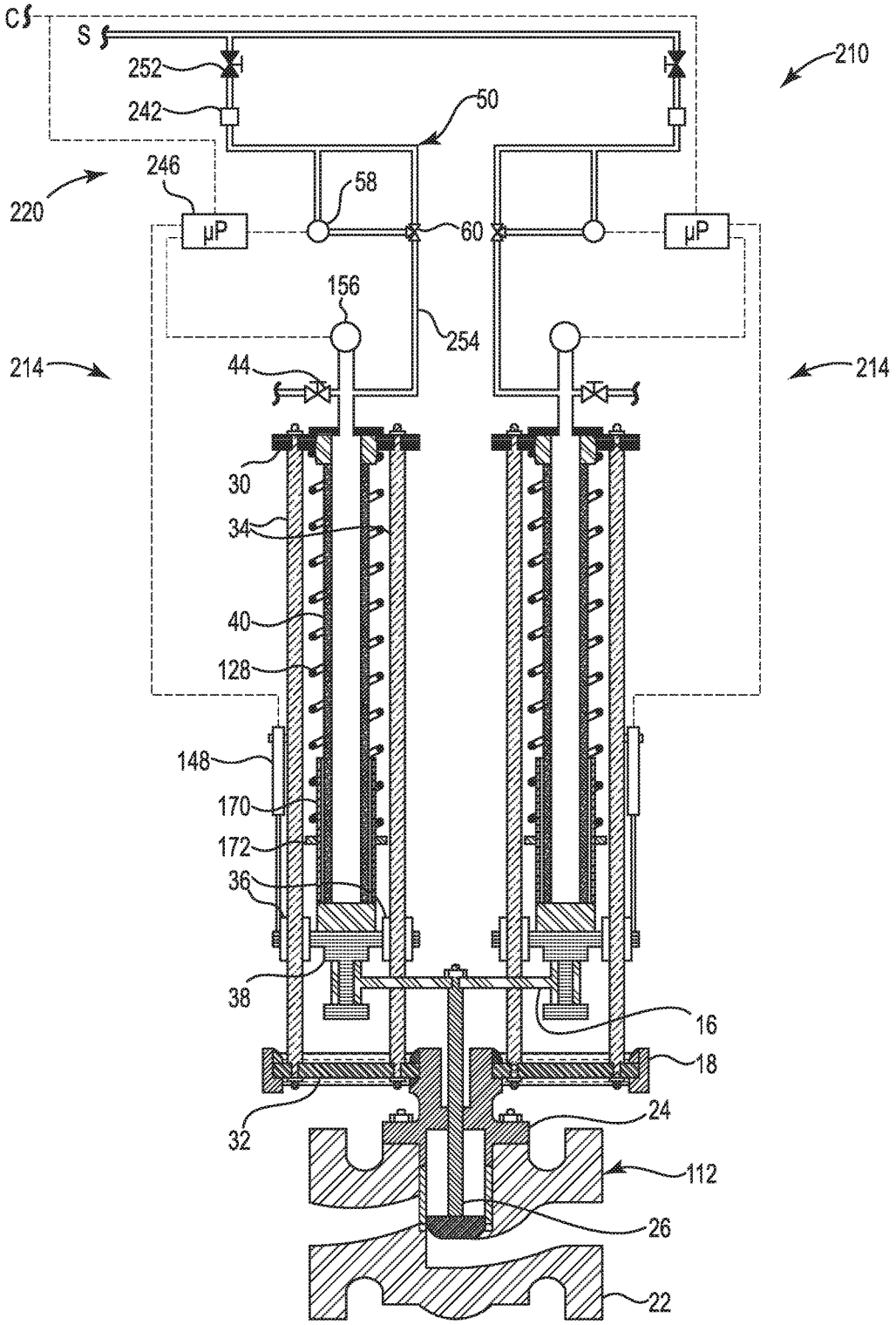
FIG. 3 is a schematic cross-sectional view of another apparatus in accordance with embodiments of the present invention.

FIG. 3 is a schematic cross-sectional view of another exemplary linear actuation apparatus connected to a device for providing linear actuation to the device, in accordance with embodiments of the present invention. FIG. 3 shows a linear actuation apparatus 210 connected to the device 112. The device 112 may be as described above in reference to FIG. 2. The linear actuation apparatus 210 may include a plurality of pneumatic linear actuator modules 214 (two shown in FIG. 3), a plurality of isolation valves 252 (two shown in FIG. 3), the dynamic actuator linkage 16, and the static actuator linkage 18. The dynamic actuator linkage 16 and the static actuator linkage 18 may be as described above in reference to FIG. 1A.

Each of the plurality of isolation valves 252 is disposed between the compressed gas supply S and a corresponding one of each of the pneumatic linear actuator modules 214. By selectively opening or closing one of the plurality of header isolation valves 252, a corresponding one of the plurality of pneumatic linear actuator modules 214 may be selectively connected to, or isolated from, the compressed gas supply S.

Each of the pneumatic linear actuator modules 214 may be substantially the same. The pneumatic linear actuator module 214 may be identical to the pneumatic linear actuator module 14 described above in reference to FIGS. 1A and 1B, except that each of the pneumatic linear actuator modules 214 may further include the biasing element 128, the threaded column 170, the threaded nut 172, a pneumatic controller 220, and a pneumatic fitting 242. The biasing element 128, the threaded column 170, and the threaded nut 172 may be as described above in reference to FIG. 2. The pneumatic fitting 242 may be as described above for the pneumatic fitting 42 in reference to FIG. 1A, except that it may connect the pneumatic linear actuator module 214 to the compressed gas supply S by way of one of the plurality of isolation valves 252.

As shown in FIG. 3, the pneumatic controller 220 may include a processor 246, the position transducer 148, the pneumatic control mechanism 50, and a pneumatic control line or header 254. The pneumatic controller 220 may optionally include the pressure transducer 156. The pneumatic control mechanism 50 may be as described above in reference to FIG. 1A. The position transducer 148 and the pressure transducer 156 may be as describe above in reference to FIG. 2. The processor 246 may be electrically connected to the control input C, the position transducer 148, the pneumatic control mechanism 50, and the pressure transducer 156. The processor 246 may be an electronic microprocessor. The pneumatic control mechanism 50 may pneumatically connect the compressed gas supply S from the pneumatic fitting 242 to the pneumatic control line 254. The pneumatic control line 254 may be pneumatically connected to the fluidic actuator 40. In some embodiments, the pneumatic control mechanism 50 may include a current-to-pressure (I/P) transducer 58 and a volume booster 60, as shown in FIG. 3. The I/P transducer 58 is electrically connected to the processor 246 and pneumatically connects the compressed gas supply S to the volume booster 60. The volume booster 60 is also directly pneumatically connected to the compressed gas supply S by way of pneumatic fitting 242 and to the pneumatic control line 254.

In operation, for each of the plurality of pneumatic linear actuator modules 214, the processor 246 of pneumatic controller 220 may receive a signal from the control input C indicating a desired level of actuation of the device 212, for example increasing the level of actuation by moving the stem 26 away from the fully closed position. The processor 246 sends an electrical signal to the I/P transducer 58 of the pneumatic control mechanism 50. The electrical signal may be a function of the signal from the control input C, the electrical signal from the position transducers 148, and the electrical signal from the pressure transducer 156. The I/P transducer 58 modulates a pressure from the compressed gas supply S in response to the electrical signal from the processor 246 to provide a pneumatic control signal to the volume booster 60. The pneumatic control signal from the I/P transducer 58 increases the pressure supplied by volume booster 60 from the compressed gas supply S to the pneumatic control line 254. The increased pressure supplied from the pneumatic control line 254 increases the pressure within the fluidic actuator 40, generating a tensile force between opposite ends of the fluidic actuator 40. The tensile force generated by the fluidic actuator 40 pulls the translating member 38 toward the first member 30 and away from the second member 32. Movement of the translating member 38 toward the first member 30 and away from the second member 32 for each of the plurality of pneumatic linear actuator modules 214 also moves the dynamic actuator linkage 16 away from the static actuator linkage 18. The tensile force produced by the plurality of pneumatic linear actuator modules 214 is sufficient to overcome the biasing force of the biasing elements 128 in each of the pneumatic linear actuator modules 214 and move the valve stem 26 away from the fully closed position.

Fine adjustment of the position of the stem 26 may be accomplished through the electrical signal from the position transducer 148 to the processor 246. Fine control of the pressure supplied to the fluidic actuator 40 may be accomplished through the electrical signals from the pressure transducer 156 to the processor 246.

As with the embodiments of the linear actuation apparatus 10 and the linear actuation apparatus 110 described above, the linear actuation apparatus 210 is configured such that a number of pneumatic linear actuator modules 214 one less than the plurality of pneumatic linear actuator modules 214 are able to provide linear actuation to the device 112. Should one of the plurality of pneumatic linear actuator modules 214 fail, it may be replaced without any downtime in the operation of the linear actuation apparatus 210 and its control of device 112. For example, once one of the pneumatic linear actuator modules 214 has been identified as failed or failing, replacement begins by disconnecting or isolating the pneumatic linear actuator module 214 from the compressed gas supply S by closing the isolation valve 252 corresponding to the pneumatic linear actuator module 214 to be replaced. The bleed valve 44 may then be opened to relieve any pressure within and pneumatic fitting 242 may be disconnected from the isolation valve 252. The pneumatic controller 220 may also be electrically disconnected from the control input C. The pneumatic linear actuator module 214 to be replaced may then be physically decoupled from the linear actuation apparatus 210 by disconnecting the translating member 38 from the dynamic actuator linkage 16, and disconnecting the second member 32 from the static actuator linkage 18.

Installing a replacement pneumatic linear actuator module 214 is done by connecting the second member 32 to the static actuator linkage 18, and connecting the translating member 38 to the dynamic actuator linkage 16 to physically couple the replacement pneumatic linear actuator module 214. Then the pneumatic fitting 242 of the replacement pneumatic linear actuator module 214 may be connected to the isolation valve 252 and the bleed valve 44 closed. Next, the header isolation valve 252 may be opened to connect the replacement pneumatic linear actuator module 214 to the compressed gas supply S. In this way, a failed or failing pneumatic linear actuator module 214 may be replaced with no downtime in the operation of device 112.

The linear actuation apparatus 210 may be more reliable than the linear actuation apparatus 10 or the linear actuation apparatus 110 described above because if one of the pneumatic controllers 220 fails, its functions are duplicated in the each of the remaining plurality of pneumatic linear actuators 214. In addition, replacing a failed pneumatic controller 220 requires no downtime because they are part of the pneumatic linear actuator modules 214, which may be replaced without any system downtime, as described above.

Figure 4:
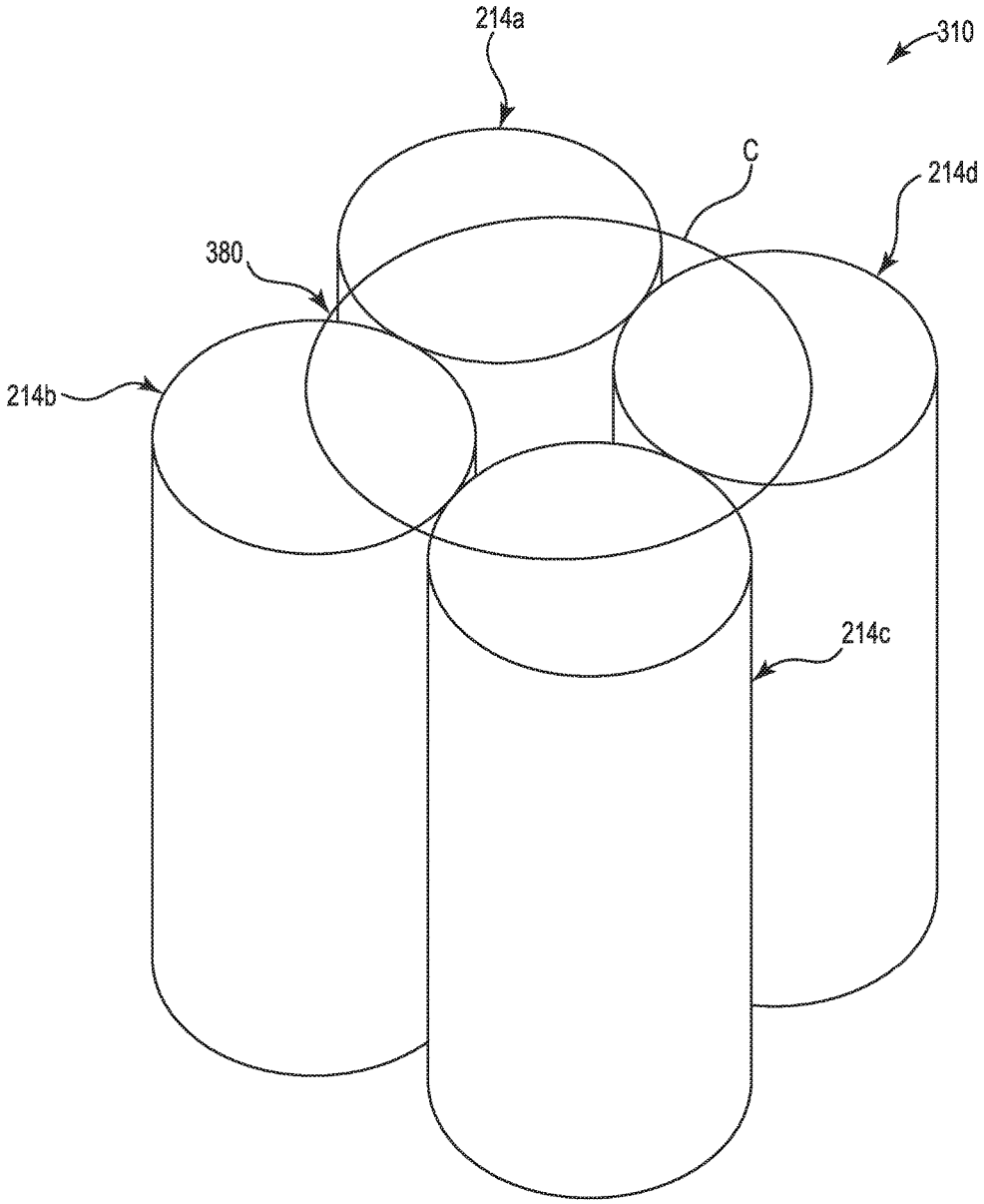
FIG. 4 is a schematic view of an apparatus in accordance with embodiments of the present invention.

FIG. 4 is a schematic view of an apparatus in accordance with embodiments of the present invention. FIG. 4 shows an exemplary linear actuation apparatus 310 for providing linear actuation to a device, such as the device 112 described above in reference to FIG. 2 by way of a dynamic actuator linkage and a static actuator linkage, such as the dynamic actuator linkage 16 and the static actuator linkage 18 described above in reference to FIG. 1A. The device is omitted for clarity. The dynamic actuator linkage and the static actuator linkage are part of linear actuation apparatus 310 and are also omitted for clarity. As shown in FIG. 4, the linear actuation apparatus 310 may also include a plurality of pneumatic linear actuator modules 214*a*, 214*b*, 214*c*, and 214*d*, and a local control loop 380. The pneumatic linear actuator modules 214*a*, 214*b*, 214*c*, and 214*d* may be identical to the pneumatic linear actuator modules 214 described above in reference to FIG. 3. The local control loop 380 is electrically connected to the processors 246 of each of the plurality of pneumatic linear actuator modules 214*a*, 214*b*, 214*c*, and 214*d*, and may provide the control input C indicating a desired level of actuation to each of them. The local control loop 380 may also provide communication between each of the plurality of linear actuator modules 214*a*, 214*b*, 214*c*, and 214*d*.

In some embodiments, each of the plurality of pneumatic linear actuator modules 214*a*, 214*b*, 214*c*, and 214*d* may receive the same control signal from control input C by way of the local control loop 380. One of the plurality of pneumatic linear actuator modules 214*a*, 214*b*, 214*c*, and 214*d*, for example, the pneumatic linear actuator module 214*a*, may be designated a primary control module, and the remaining of pneumatic linear actuator modules 214*b*, 214*c*, and 214*d* may be designated as secondary control modules. So configured, the pneumatic linear actuator module 214*a* may act as the primary control module and may send a loop control signal to each of the secondary control modules, the pneumatic linear actuator modules 214*b*, 214*c*, and 214*d*, in response to the control signal from control input C. As secondary control modules, the pneumatic linear actuator modules 214*b*, 214*c*, and 214*d* may actuate in response to the loop control signal and may ignore the control signal from control input C. In this way, one of the plurality of pneumatic linear actuator modules, the pneumatic linear actuator module 214*a*, may control and coordinate the actuation of all of the pneumatic linear actuator modules of linear actuation apparatus 310.

As with the embodiments of the linear actuation apparatus 210 described above, the linear actuation apparatus 310 is configured such that a number of pneumatic linear actuator modules 214 one less than the plurality of pneumatic linear actuator modules 214 are able to provide linear actuation to the device 112. As shown in FIG. 4, this means that should one of the plurality of pneumatic linear actuator modules 214*a*, 214*b*, 214*c*, and 214*d*, fail, it may be replaced without any downtime in the operation of the linear actuation apparatus 310. Should any of the secondary actuator modules fail, replacement is as described above for the pneumatic linear actuator module 214 in reference to FIG. 3. Should the primary actuator module fail, replacement is still as described above in reference to FIG. 3, except that once the pneumatic linear actuator module 214*a* fails, or is removed from the linear actuation apparatus 310, one of the remaining pneumatic linear actuator modules, for example, pneumatic linear actuator module 214*b*, may automatically become the primary module and may send the loop control signal to each of the remaining secondary control modules, the pneumatic linear actuator modules 214*c*, and 214*d*, in response to the control signal from control input C. Once replacement for the failed pneumatic linear actuator module 214*a* is installed, it may become the primary actuator module and the pneumatic linear actuator module 214*b* may return to being one of the secondary actuator modules. Alternatively, the replacement for the failed pneumatic linear actuator module 214*a* may be a secondary actuator module, and the pneumatic linear actuator 214*b* may continue to be the primary actuator module until it is replaced.

In this way, one of the plurality of pneumatic linear actuator modules 214*a*, 214*b*, 214*c*, and 214*d* may control and coordinate the actuation of all of the pneumatic linear actuator modules of linear actuation apparatus 310 while a failed or failing pneumatic linear actuator module may be replaced without any downtime in the operation of the linear actuation apparatus 310.

Figure 5:
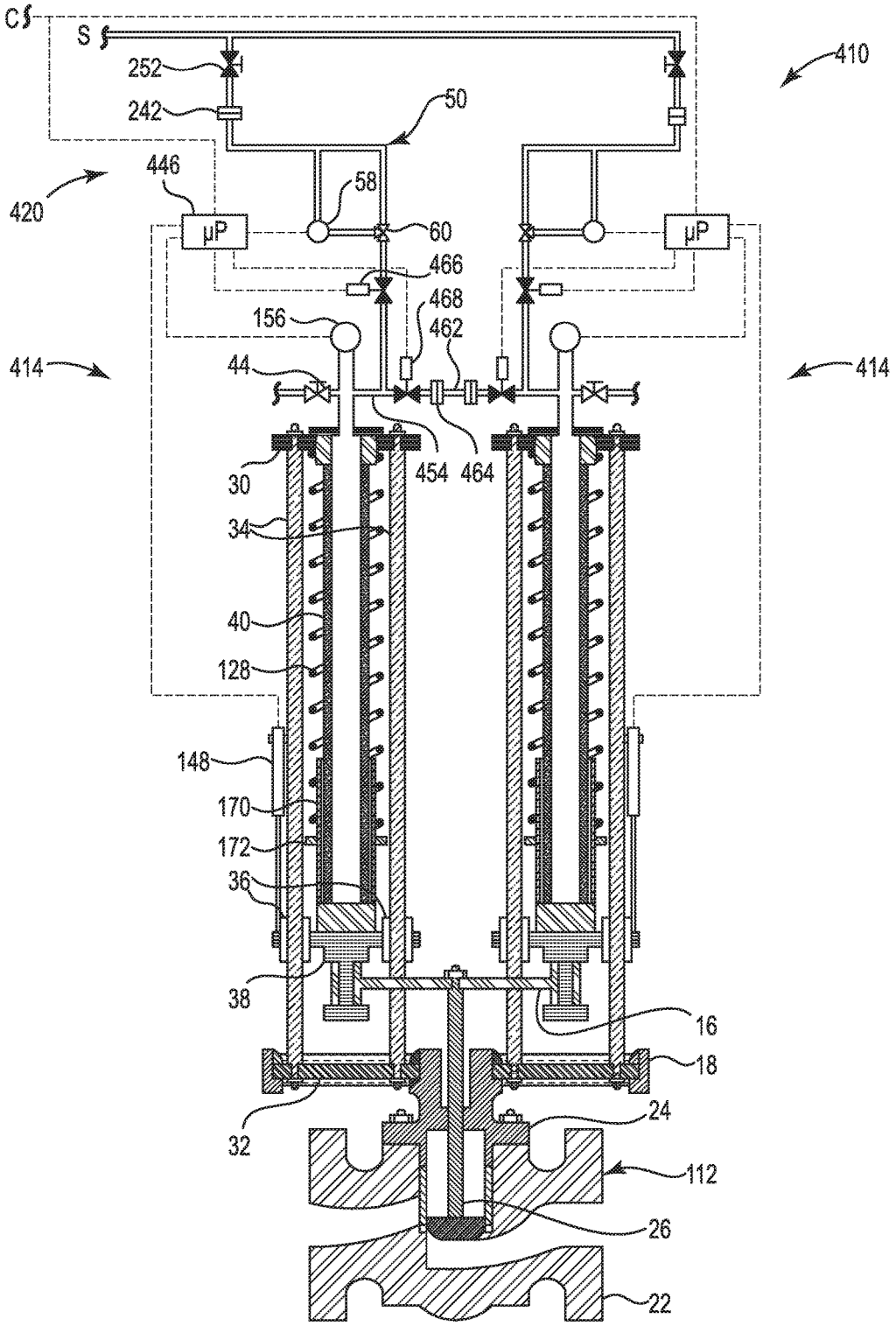
FIG. 5 is a schematic cross-sectional view of another apparatus in accordance with embodiments of the present invention.

FIG. 5 is a schematic cross-sectional view of another exemplary linear actuation apparatus connected to a device for providing linear actuation to the device, in accordance with embodiments of the present invention. FIG. 5 shows a linear actuation apparatus 410 connected to the device 112. The device 112 may be as described above in reference to FIG. 2. The linear actuation apparatus 410 may include a plurality of pneumatic linear actuator modules 414 (two shown in FIG. 5), a plurality of isolation valves 252 (two shown in FIG. 5), a common header 462, the dynamic actuator linkage 16, and the static actuator linkage 18. The dynamic actuator linkage 16 and the static actuator linkage 18 may be as described above in reference to FIG. 1A. The common header 462 may be pneumatically connected to all of the plurality of linear actuator modules 414 to equalize the pressure in all of the fluidic actuators 40, as described below.

Each of the plurality of isolation valves 252 is disposed between the compressed gas supply S and a corresponding one of each of the pneumatic linear actuator modules 414. By selectively opening or closing one of the plurality of header isolation valves 252, a corresponding one of the plurality of pneumatic linear actuator modules 414 may be selectively connected to, or isolated from, the compressed gas supply S.

Each of the pneumatic linear actuator modules 414 may be substantially the same. The pneumatic linear actuator module 414 may be identical to the pneumatic linear actuator module 214 described above in reference to FIG. 3, except that a pneumatic controller 420 replaces the pneumatic controller 220, and each of the pneumatic linear actuator modules 414 may further include a pneumatic fitting 464. The pneumatic fitting 464 may be as described above for the pneumatic fitting 242 in reference to FIG. 3, except that it may connect the pneumatic linear actuator module 414 to the common header 462, as shown in FIG. 5.

As shown in FIG. 5, the pneumatic controller 420 may include the processor 446, the position transducer 148, the pneumatic control mechanism 50, a pneumatic control line or header 454, a control line pneumatic valve 466, and a common header pneumatic valve 468. The pneumatic controller 420 may optionally include the pressure transducer 156. The pneumatic control mechanism 50 may be as described above in reference to FIG. 1A. The position transducer 148 and the pressure transducer 156 may be as describe above in reference to FIG. 2. The control line pneumatic valve 466 and the common header pneumatic valve 468 may be, for example, solenoid actuated valves. The processor 446 may be electrically connected to the control input C, the position transducer 148, the pneumatic control mechanism 50, the pressure transducer 156, the control line pneumatic valve 466, and the header pneumatic valve 468. The processor 446 may be an electronic microprocessor.

As shown in FIG. 5, the pneumatic control line 454 may selectively pneumatically connect the fluidic actuator 40 to the pneumatic control mechanism 50 by way of the control line pneumatic valve 466, and to the common header 464 by way of the header pneumatic valve 468. In some embodiments, the pneumatic control mechanism 50 may include a current-to-pressure (I/P) transducer 58 and a volume booster 60. The I/P transducer 58 is electrically connected to the processor 446 and pneumatically connects the compressed gas supply S to the volume booster 60. The volume booster 60 is also directly pneumatically connected to the compressed gas supply S by way of pneumatic fitting 242 and to the pneumatic control line 454 by way of the control line pneumatic valve 466.

In operation, for each of the plurality of pneumatic linear actuator modules 414, the processor 446 of pneumatic controller 420 may receive a signal from the control input C indicating a desired level of actuation of the device 112, for example increasing the level of actuation by moving the stem 26 away from the fully closed position. The pneumatic controller 420 may also receive a signal from the control input C indicating one of four alternative states for control of each of the pneumatic linear actuator modules 414. In a first state, the pneumatic linear actuator module 414 is directed to operate as a stand-alone unit, operating as described above for the pneumatic linear actuator module 214 in reference to FIG. 3 to move the valve stem 26 away from the fully closed position. In the first state, the processor 446 sends electrical signals to open the control line pneumatic valve 466 and close the common header pneumatic valve 468, matching the configuration of the pneumatic linear actuator module 214.

In a second state, the pneumatic linear actuator module 414 is directed to control the other pneumatic linear actuator modules 414. In the second state, the processor 446 sends electrical signals to open both the control line pneumatic valve 466 and the common header pneumatic valve 468. The processor 446 sends an electrical signal to the I/P transducer 58 of the pneumatic control mechanism 50. The electrical signal may be a function of the signal from the control input C, the electrical signal from the position transducers 148, and the electrical signal from the pressure transducer 156. The I/P transducer 58 modulates a pressure from the compressed gas supply S in response to the electrical signal from the processor 446 to provide a pneumatic control signal to the volume booster 60. The pneumatic control signal from the I/P transducer 58 increases the pressure supplied by volume booster 60 from the compressed gas supply S to the pneumatic control line 454 and to the other pneumatic linear actuator modules 414 by way of their connection to the common header 462. The increased pressure supplied from the pneumatic control line 454 increases the pressure within the fluidic actuator 40 of each of the plurality of pneumatic linear actuator modules 414, generating a tensile force between opposite ends of the fluidic actuator 40. The tensile force produced by the plurality of pneumatic linear actuator modules 414 is sufficient to overcome the biasing force of the biasing elements 128 in each of the pneumatic linear actuator modules 414 and move the valve stem 26 away from the fully closed position.

In a third state, the pneumatic linear actuator module 414 is directed to be controlled by one of the other pneumatic linear actuator modules 414. In the third state, the processor 446 sends electrical signals to close the control line pneumatic valve 466 and open the common header pneumatic valve 468. In this state, increased pressure is supplied to the pneumatic control line 454 exclusively from the common header 462, which is controlled by the one of the other pneumatic linear actuator modules 414. The increased pressure supplied from the pneumatic control line 454 increases the pressure within the fluidic actuator 40 of each of the plurality of pneumatic linear actuator modules 414, generating a tensile force between opposite ends of the fluidic actuator 40. The tensile force produced by the plurality of pneumatic linear actuator modules 414 is sufficient to overcome the biasing force of the biasing elements 128 in each of the pneumatic linear actuator modules 414 and move the valve stem 26 away from the fully closed position.

In a fourth state, the pneumatic linear actuator module 414 is directed to isolate the pneumatic control line 454 from both the output of the pneumatic control mechanism 50 and the common header 462. In the fourth state, the processor 446 sends electrical signals to close the control line pneumatic valve 466 and the common header pneumatic valve 468. In this "hold" state may be employed, for example, when no change in the pressure within the fluidic actuator 40 is desired, or as in intermediate state prior to entering any of the first, second, or third states.

As with the embodiments of the linear actuation apparatus 10, the linear actuation apparatus 110, and the linear actuation apparatus 210 described above, the linear actuation apparatus 410 is configured such that a number of pneumatic linear actuator modules 414 one less than the plurality of pneumatic linear actuator modules 414 are able to provide linear actuation to the device 112. Should one of the plurality of pneumatic linear actuator modules 414 fail, it may be replaced without any downtime in the operation of the linear actuation apparatus 410 and its control of device 112. For example, if one of the plurality of pneumatic actuator modules 414 is in the state two and identified as failed or failing, another one of the plurality of pneumatic linear actuator modules 414 may receive a signal from the control input C to go to state two to take over control of the other of the pneumatic linear actuator modules 414. Once the failed pneumatic linear actuator module 414 is not controlling, it may be replaced and a new pneumatic linear actuator module 414 installed as described above in reference to FIG. 3 by disconnecting and reconnecting pneumatic fittings 242 and 464. In this way, a failed or failing pneumatic linear actuator module 414 may be replaced with no downtime in the operation of device 112.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features. And further, use of the term "may" within the description of the various embodiments is intended to mean may as opposed to must, may only, can only, necessarily or another absolute term.

The invention claimed is:

1. An apparatus for providing linear actuation to a device having a moveable portion and an immoveable portion, the apparatus comprising:

a plurality of pneumatic linear actuator modules, each of the plurality of pneumatic linear actuator modules including a static portion and a dynamic portion, wherein the dynamic portion is moveable in a linear fashion relative to the static portion;

a dynamic actuator linkage configured to connect the dynamic portion of each of the plurality of pneumatic linear actuator modules to the moveable portion of the device; and a static actuator linkage configured to connect the static portion of each of the plurality of pneumatic linear actuator modules to the immoveable portion of the device;

wherein a number of pneumatic linear actuator modules one less than the plurality of pneumatic linear actuator modules are configured to provide linear actuation to the device, and each of the plurality of actuator modules is configured to selectively couple and decouple to the dynamic actuator linkage and the static actuator linkage, each of the plurality of actuator modules including:

a first member;

a second member;

a plurality of linear guides connecting the first member to the second member;

a plurality of linear bearings configured to move along the plurality of linear guides;

a translating member connected to the plurality of linear bearings;

a fluidic actuator connecting the translating member to the first member; and a pneumatic fitting connected to the fluidic actuator, the pneumatic fitting configured to connect the fluidic actuator to a pneumatic line;

wherein the translating member is the dynamic portion of the pneumatic linear actuator module and the second member is the static portion of the pneumatic linear actuator module.

2. The apparatus of claim 1, wherein the device is a control valve, the moveable portion of the device is a valve stem, and the immoveable portion is a bonnet.

3. The apparatus of claim 2, wherein the static actuator linkage is integral with the bonnet.

4. The apparatus of claim 2, wherein the dynamic actuator linkage is integral with the valve stem.

5. The apparatus of claim 1, further comprising:

a pneumatic controller configured to selectively couple and decouple to each of the plurality of pneumatic linear actuator modules, the controller configured to control actuation of the plurality of pneumatic linear actuator modules.

6. The apparatus of claim 5, wherein the pneumatic controller includes:

a processor configured to receive a control input;

a position transducer electrically connected to the processor and configured to sense a position of the movable portion of the device relative to the immoveable portion of the device; and a pneumatic control mechanism electrically connected to the processor, the pneumatic control mechanism configured to connect a compressed gas supply to the plurality of pneumatic linear actuators and configured to modulate a pressure of the compressed gas supplied to the plurality of pneumatic linear actuators in response to an electrical signal from the processor, wherein the electrical signal from the processor is function of at least the control input and the sensed position of the moveable portion of the device relative to the immoveable portion of the device.

7. The apparatus of claim 6, wherein the pneumatic controller further includes a pressure transducer electrically connected to the processor and configured to sense the pressure of the compressed gas supplied to the plurality of pneumatic linear actuators, and wherein the electrical signal from the processor is additionally a function of the sensed pressure of the compressed gas supplied to the plurality of pneumatic linear actuators.

8. The apparatus of claim 5, wherein the first member is a first plate, a second member is a second plate, and the translating member is a translating plate, and wherein each of the plurality of actuator modules further includes a biasing member configured to apply a biasing force countering a force applied between the first plate and the translating plate by the fluidic actuator.

9. The apparatus of claim 8, wherein each of the plurality of actuator modules further includes:

a threaded cylindrical column connected on one end to the translating plate and projecting toward the first plate, wherein the column includes a hollow interior extending the length of the column, and an exterior including threads extending at least a portion of the length of the column; and a nut configured to threadedly engage the threads of the column, wherein the biasing member is disposed between the nut and the first plate such that the biasing force is adjustable by threading the nut along the column.

10. The apparatus of claim 9, wherein each of the plurality of actuator modules further includes a position transducer electrically connected to the pneumatic controller and configured to sense a position of the translating plate.

11. The apparatus of claim 10, wherein the pneumatic controller includes:

a processor configured to receive a control input and electrically connected to the position transducer of each of the plurality of actuator modules; and a pneumatic control mechanism electrically connected to the processor, the pneumatic control mechanism is configured to connect a compressed gas supply to the plurality of pneumatic linear actuators and configured to modulate a pressure of the compressed gas supplied to the plurality of pneumatic linear actuators in response to an electrical signal from the processor, wherein the electrical signal from the processor is function of at least the control input and the sensed position of the translating plate of each of the plurality of pneumatic linear actuator modules.

12. The apparatus of claim 11, wherein the each of the plurality of actuator modules further includes a pressure transducer electrically connected to the processor and configured to sense the pressure of the compressed gas supplied to the pneumatic linear actuator, and wherein the electrical signal from the processor is additionally a function of the sensed pressure of the compressed gas supplied to each of the plurality of pneumatic linear actuators.

13. A method for providing linear actuation of a device having a moveable portion and an immoveable portion, the method comprising:

coupling a plurality of pneumatic linear actuation modules to the device by connecting a dynamic portion of each of the pneumatic linear actuator modules to the moveable portion of the device, and connecting a static portion of each of the pneumatic linear actuator modules to the immoveable portion of the device;

connecting a compressed gas supply to each of the plurality of pneumatic linear actuation modules;

modulating a pressure of the compressed gas supplied to the plurality of pneumatic linear actuators to provide linear actuation of the device, wherein a number of pneumatic linear actuator modules one less than the plurality of pneumatic linear actuator modules are able to provide linear actuation of the device; and replacing a one of the plurality of pneumatic linear actuation modules while modulating the pressure of the remainder of the plurality of pneumatic linear actuation modules to provide uninterrupted linear actuation of the device.

14. The method of claim 13, wherein the one of the plurality of pneumatic linear actuation modules comprise a failed or failing one of the plurality of pneumatic linear actuation modules and wherein the replacing includes:

identifying the failed or failing one of the plurality of pneumatic linear actuation modules to be replaced;

disconnecting the compressed gas supply from the identified pneumatic linear actuation module;

decoupling the identified pneumatic linear actuation module from the device by disconnecting the dynamic portion of the pneumatic linear actuator module from the moveable portion of the device, and disconnecting the static portion of the pneumatic linear actuator module from the immoveable portion of the device;

coupling a replacement pneumatic linear actuation module to the device by connecting a dynamic portion of the replacement pneumatic linear actuator module to the moveable portion of the device, and connecting a static portion of the replacement pneumatic linear actuator module to the immoveable portion of the device; and connecting the compressed gas supply to the replacement pneumatic linear actuation module.

15. An apparatus for providing linear actuation to a device having a moveable portion and an immoveable portion, the apparatus comprising:

a plurality of pneumatic linear actuator modules, each of the plurality of pneumatic linear actuator modules including a static portion and a dynamic portion, wherein the dynamic portion is moveable in a linear fashion relative to the static portion;

a dynamic actuator linkage configured to connect the dynamic portion of each of the plurality of pneumatic linear actuator modules to the moveable portion of the device; and a static actuator linkage configured to connect the static portion of each of the plurality of pneumatic linear actuator modules to the immoveable portion of the device;

wherein a number of pneumatic linear actuator modules one less than the plurality of pneumatic linear actuator modules are configured to provide linear actuation to the device, and each of the plurality of actuator modules is configured to selectively couple and decouple to the dynamic actuator linkage and the static actuator linkage, each of the plurality of actuator modules including:

a first member;

a second member;

a plurality of linear guides connecting the first member to the second member;

a plurality of linear bearings configured to move along the plurality of linear guides;

a translating member connected to the plurality of linear bearings;

a fluidic actuator connecting the translating member to the first member;

a first pneumatic fitting connected to the fluidic actuator, the first pneumatic fitting configured to selectively couple the pneumatic linear actuator module to a compressed gas supply; and a pneumatic controller configured to selectively couple the pneumatic linear actuator module to a control input, the pneumatic controller including:

a processor configured to receive the control input;

a position transducer electrically connected to the processor and configured to sense a position of the translating member; and a pneumatic control mechanism electrically connected to the processor, the pneumatic control mechanism connecting a compressed gas supply from the pneumatic line to the plurality of pneumatic linear actuators and configured to modulate a pressure of the compressed gas supplied to the pneumatic linear actuator in response to an electrical signal from the processor, wherein the electrical signal from the processor is function of at least the control input and the sensed position of the translating member.

16. The apparatus of claim 15, wherein the first member is a first plate, a second member is a second plate, and the translating member is a translating plate, and wherein each of the plurality of actuator modules further includes a biasing member configured to apply a biasing force countering a force applied between the first plate and the translating plate by the fluidic actuator.

17. The apparatus of claim 16, wherein each of the plurality of actuator modules further includes:

a threaded cylindrical column connected on one end to the translating plate and projecting toward the first plate, wherein the column includes a hollow interior extending the length of the column, and an exterior including threads extending at least a portion of the length of the column; and a nut configured to threadedly engage the threads of the column, wherein the biasing member is disposed between the nut and the first plate such that the biasing force is adjustable by threading the nut along the column.

18. The apparatus of claim 15, wherein the each of the plurality of pneumatic linear actuator modules further includes a pressure transducer electrically connected to the processor and configured to sense the pressure of the compressed gas supplied to the fluidic actuator, and wherein the electrical signal from the processor is additionally a function of the sensed pressure of the compressed gas supplied to the fluidic actuator.

19. The apparatus of claim 15, further including a local control loop, wherein the processors of each of the plurality of pneumatic linear actuator modules are electrically connected to the local control loop to receive the control input.

20. The apparatus of claim 19, wherein one of the plurality of pneumatic linear actuator modules provides the control input to each of the remaining plurality of pneumatic linear actuator modules.

21. The apparatus of claim 15, further including:

a common header configured to pneumatically connect to the fluidic actuators of each of the plurality of actuator modules;

wherein each of the plurality of actuator modules further includes a second pneumatic fitting connected to the fluidic actuator, the second pneumatic fitting configured to selectively couple the pneumatic linear actuator module to the common header; and wherein the pneumatic controller further includes a first pneumatic valve to selectively connect the fluid actuator to the compressed gas supply, and a second pneumatic valve to selectively connect the fluid actuator to the common header.

* * * * *